United States Patent [19]

Forde et al.

[11] 4,185,601

[45] Jan. 29, 1980

[54] PHOTO ELECTRIC IGNITION SYSTEM

[76] Inventors: Louis Forde; Alonzo C. Forde; Gregory L. Forde; Alfredo Forde; Raymond Forde, all of 482 Berriman St., Brooklyn, N.Y. 11208

[21] Appl. No.: 880,205

[22] Filed: Feb. 22, 1978

[51] Int. Cl.[2] ..... F02P 1/00

[52] U.S. Cl. ..... 123/146.5 A; 123/148 E; 250/229

[58] Field of Search ..... 123/148 E, 148 CB, 146.5 A; 324/175; 250/229, 231 SE

[56] References Cited

U.S. PATENT DOCUMENTS

| | | | |
|---|---|---|---|
| 2,671,174 | 3/1954 | Burgholz | 324/175 |
| 3,244,895 | 4/1966 | Anderegg | 250/231 SE |
| 3,605,712 | 9/1971 | Ford | 123/148 E |
| 3,702,070 | 11/1972 | Gartner | 250/229 |
| 3,780,297 | 12/1973 | Greary | 324/175 |

*Primary Examiner*—Ronald B. Cox

[57] ABSTRACT

A photo electric ignition system for an internal combustion engine is described which comprises a timing housing having an orifice on its upper surface admitting light beams from a radiant energy source.

A light sensing photo electric cell is operated by an input frequency control rotor. The rotary member comprising a cone shaped rotor having an open end chamber with angularly spaced apart apertures extending there into. The rotor is mounted on a driving shaft which is connected to a crankshaft in the engine block. The open end chamber being rotated adjacent the orifice on the surface of the timer allows alternate focusing and blocking of light beams from radiant energy source on the photo cell so to operate the cell a number of degrees in synchronism with the engine rotations.

The phased interval signal provided by the photo cell is transmitted to an amplifier which is interconnected to an ignition coil providing high voltage firings for the spark plugs in the engine cylinders.

7 Claims, 4 Drawing Figures

PHOTO ELECTRIC IGNITION SYSTEM

FIELD OF INVENTION

This invention which is a continuation-in-part of application Ser. No. 671,661 relates to an ignition system for an internal combustion engine.

Prior art ignition systems for internal combustion engines are of the type utilizing mechanical circuit breakers, the magnetic pulse breakerless type, and the incandescent exhaust assisted type. Systems utilizing mechanical or magnetic circuit breakers require an electrical feed to the distributor in order to control the primary circuit to the ignition coil thereby causing the coil to produce secondary high voltage firings.

The disadvantages are; initial high costs, complex circuitry resulting in lack of adequate servicing, etc. are often cited as objects to be improved.

Electronics has enabled us to graft onto machines a human attribute-- an eye, far more sensitive and durable than the human eye, yet very low in cost. Devices photo electrically controlled operate supermarket doors, drinking fountains, record player turntable arms, burglar alarms, etc. and makes possible wire or radio transmission of pictures.

The photo electric effect is a phenomenon which occurs when radiant energy is absorbed by certain metals, electrons are emitted from the metallic surface. Light which is a source of radiant energy travels as a continuous wave. The intensity or power of the wave depends on its amplitude. The intensity of the light determine the energy of each electron emitted. As light shines on the emitter of a photo cell electrons are freed from it and are attracted to a collector in the photo cell which is maintained at a positive potential. The flow of photo electric current is circuited back to the emitter in the photo cell.

The signals emitted by the photo cell in the system at timed intervals are transmitted to an ignition coil from the amplifier wherein accordingly they a are transformed to high voltage sparks, and wherein accordingly they would be applied to the ignition plugs the promote combustion in the engine cylinders.

The features and inherent advantages of the present invention, will, in part, be pointed out with particularity, and will, in part, become obvious from the following more detailed description of the invention taken in conjunction with the accompanying drawings which form an integral part thereof.

DESCRIPTION OF THE PREFERRED EMBODIMENT

Figure 1:
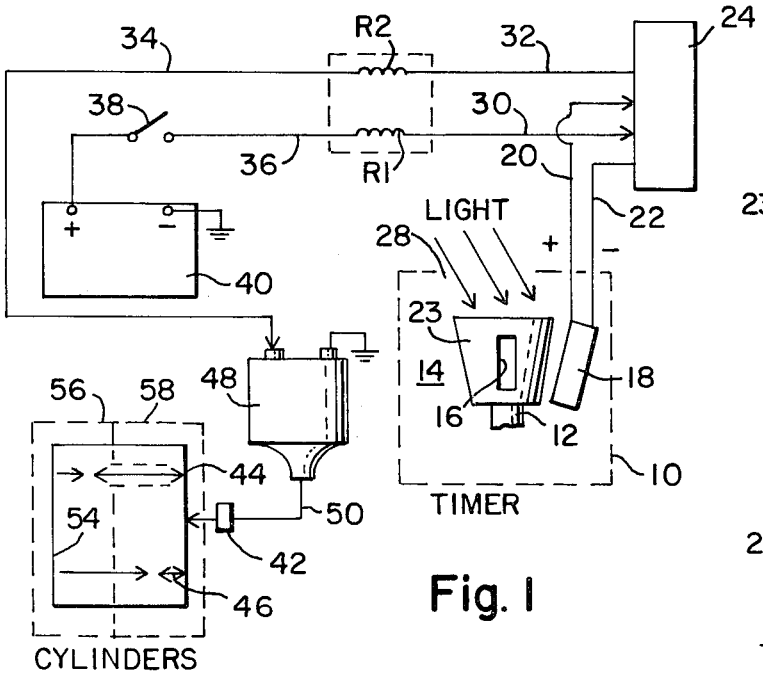
FIG. 1 is a schematic circuit diagram showing an embodiment of the ignition system of the present invention.

Referring now to FIG. 1, there is shown an electric circuit utilizing the igition timer of the present invention. In the timer housing 10 is shown a rotatably disposed driving shaft 12 which wiould be connected to the crankshaft in the engine block. Mounted on the driving shaft 12 is the rotatable cone shaped member shown generally at 14. An aperture 16 for focusing is shown on member 14. The combination of member 14 and shaft 12 defines a rotatable Y member.

A photo electric cell 18 is shown in FIG. 1 in posi in an inclined angle which is parallel to the sloping angle of the periphery of the surface of member 14. The photo electric cell 18 hereinafter will be called a sensor. The benefit of the sensor 18 being positioned in an inclined angle parallel to the sloping angle of the cone-shaped rotor 14 is that it provides a larger exposure area to the focusing light beams. The advantage is substantiated in the following geometrical formula:

The diagonal of a right triangle is longer than the height or the base expressed as follows $$2\sqrt{B^2+H^2}=D$$

or $$D^2=B^2+H^2$$

The sensor 18 is respectively connected to amplifier 24 by means of feed wire 20 providing photo electric current thereto. Photo electric current is circuited back to sensor 18 from amplifier 24 by means of wire 22. An orifice 28 on the upper surface of timer 10 provides means for admitting light beams from a radiant energy source thereinto. The energizer 40 is series connected to amplifier 24 providing electrical input thereinto by means of ignition switch 38, wire 36, resistor R1 and wire 30. The amplifier 24 is interconnected to ignition coil 48 by conventional feed wire 36 through resistor R2 and wire 30. Wire 50 is connected to high voltage output connector on ignition coil 48 at one end, the other end thereof is connected to a resilient contact 42 which couples ignition plug 44 disposed on rotatable switch 54, thereby providing high voltage firing to cylinder 56 at a respective time in the cycle. Ignition plug 46 is equal angularly spaced apart on rotatable switch 54 from ignition plug 44, resillient contact 42 couples ignition plug 46 disposed on rotatable switch 54, thereby providing high voltage firing to cylinder 58 at a respective time in the cycle.

Figure 2:
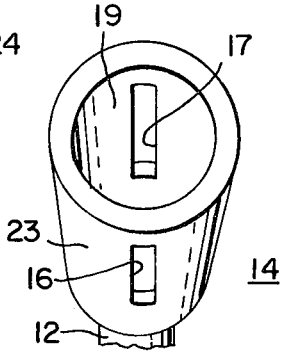
FIG. 2 is a perspective view of the rotor member including an open end chamber with equal angularly spaced focusing apertures extending thereinto for operating the photo cell shown in FIG. 1.

Referring now to FIG. 2, there is shown an embodiment of the rotary member, in accordance with the present invention, and specifically for a system admitting light through the orifice in the upper surface of the timer of the two cylinder engine as shown in FIG. 1. In the figure there is shown the rotatable cone shaped member 14 having a open end chamber 19. A plurality of angularly spaced apart focusing apertures 16 and 17 are shown on member 14 extending into open end chamber 19. The spaces 23 between aperture 16 and 17 prevent focusing of light beams admitted through orifice 28 as shown in FIG. 1 on sensor 18. The member 14 is shown mounted on driving shaft 12.

Figure 3:
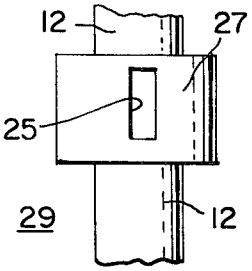
FIG. 3 is an elevational view of a second embodiment of the rotary member according to the present invention.

Referring now ti FIG. 3, there is shown a second embodiment of the rotor member utilized in the ignition system, in accordance with the present invention, and specifically for a system including a conventional secondary distribution system.

The cylindrical rotor member shown generally at 29 includes a focusing channel 25 extending transversely thereof for operation of a two cylinder engine. spaces 27 are shown between openings of channel 25. The rotor member 29 is mounted on driving shaft 12.

Figure 4:
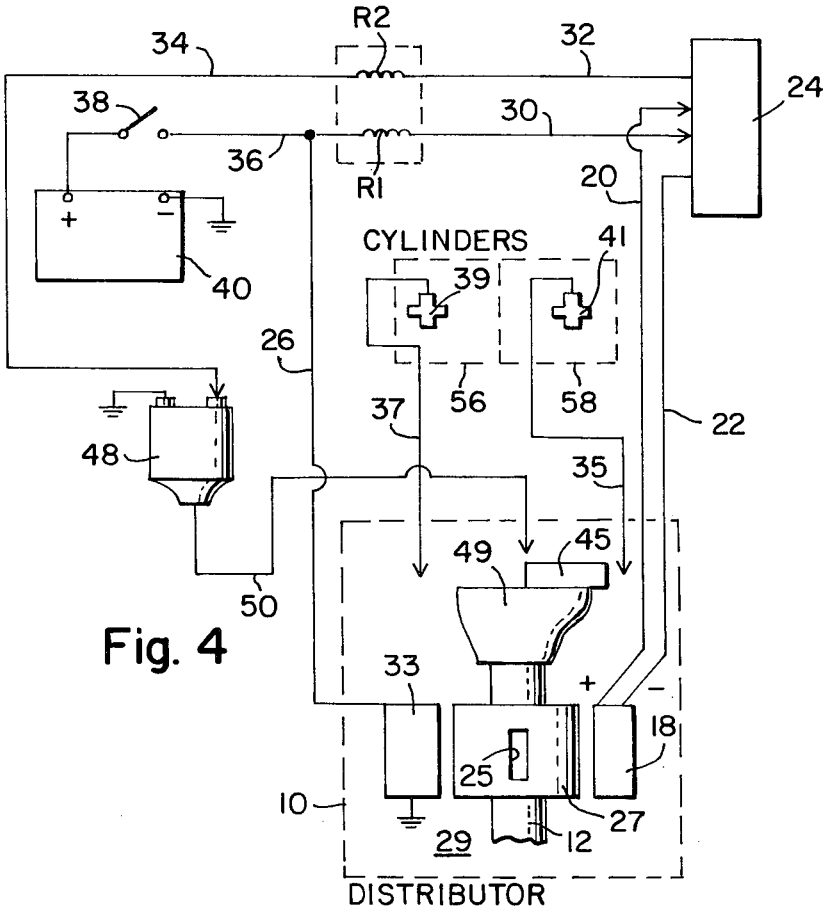
FIG. 4 is a schematic circuit diagram showing a second embodiment of the ignition system of the present invention.

Referring now to FIG. 4, there is shown a second embodiment of the electric circuit diagram utilizing the ignition distributor according to the present invention.

Inside the distributor housing 10 is shown the driving shaft 12 which would be connected to the crankshaft in the engine block mounted on the driving shaft 12 is the cylindrical member shown generally at 29. The electrical circuit is described for the system includes an energizer 40 connected to beamy emitter 33 by means of ignition switch 38 mainfeed wire 36 and conventional feed wire 26. Rotor member 29 with focusing channel 25 and spaces 27 is shown mounted on driving shaft 12 rotatably and operatively, interposed between radially aligned emitter 33 and sensor 18. Sensor 18 positioned vertically 90° is connected to amplifier 24 by means of feed wire 20 providing photo electric current the rein to providing an input signal, and the photo electric current is circuitted back from amplifier 24 by means of wire 22.

Beamy emitter 33 electrically connected to energizer 40 provides a radiant energy source means focusing through channel 25 at phased intervals. The energizer 40 is series connected to amplifier 24 providing electrical input thereinto by means of ignition switch 38, feed wire 36, resistor R1 and feed wire 30. The amplifier being interconnected to ignition coil 48 by feed wire 32, resistor R2, and wire 34.

The secondary high voltage sparks from ignition coil 48 are fed to contact lever 45 disposed on distributor rotor 49 by high voltage wire 50. A peripheral terminal contacting contact lever 45 is electrically connected to spark plug 39 by means of high voltage wire 37 providing firings into cylinder 56; and another perpheral terminal is electrically connected to spark plug 41 by means of high voltage wire 35 providing firings into cylinder 58.

The operation, according to the illustration in FIG. 1, as light beams from a radiant energy source is admitted through orifice 28 disposed on the upper surface of timer housing 10 into the timer, and as the driving shaft 12 disposed in the timer 10 is caused to rotate along with the crankshaft of the engine, the cone-shaped rotor member 14 including open end chamber 19 will be caused to rotate adjacent to orifice 28.

The admitted light beams are allowed to focus through aperture 17 causing the sensor 18 to emit photo electric current, and the other space 23 subsequently rotatably blocks sensor 18, thus preventing focusing on sensor 18 whereby sensor 18 does not emit photo electric current thereby providing a signal at phased intervals in synchronism with the engine rotations.

While two such apertures 16 and 17 are illustrated it would be understood that a plurality of such apertures and a corresponding plurality of such spaces 23 could be utilized, each of the apertures would be arranged at equal angles from each other providing a fixed relationship to each other. The frequency of the signal provided would be determined by the number of apertures which the rotor member 14 would have, which would be a function of the number of cylinders, and the rotating speed of the driving shaft.

The emitted signal being transmitted by means of feed wire 20 from sensor 18 to amplifier 24 and the photo electric current is circ itted back through wire 22 to sensor 18. The emitted signal influences the flow of electrical current from energizer 40 through ignition switch 38, conventional feed wire 36, risistor R1 and wire 30 to amplifier 24. Amplifier 24 is interconected to ignition coil 48 by means of wire 32, resistor R2 and wire 34.

The influenced circuit being connected to the primary of ignition coil 48 causes a sudden reaction of the secondary thereof, thereby ignition coil 48 produces high voltage sparks applied sucessively through wire 50 to resillient contact 42.

Resillient contact 42 connects ignition plug 44 which is disposed on rotatable switch 54 being rotated and communicating cylinder 56. Valve 54 is coupled to the crankshaft in the engine block for displacing the valve in synchronism with engine rotations.

The firing being applied to cylinder 56 at a respective time in the engine cycle to promote combustion; and the resillient contact 42 connects ignition plug 46 disposed on switch 54 which is equal angularly spaced apart from ignition plug 44 communicating cylinder 58 applying firing thereinto at a respective time in the engine cycle.

The operation, according to the illustration in FIG. 4; As beamy emitter 33 is electrically connected to energizer 40 by means of ignition switch 38 mainfeed wire 36 and conventional wire 26, a radiant energy source is provided emitting light beams, and as the driving shaft is caused to rotate in housing 10 along with the crankshaft of the engine, cylindrical member 29 including focusing channel 25 which extends transversely thereof with equal size spaces 27 will be caused to rotate allowing focusing on sensor 18 throughchannel 25 during rotation, and spaces subsequently rotatably block sensor 18, thus preventing focusing thereon. Continuous rotation allows alternate focusing and blocking of light beams from emitter 33 through channel 25 and spaces on sensor 18.

While one such channel with two openings is illustrated it would be understood a plurality of such channels and a corresponding plurality of spaces would be utilized, each of the openings of the channels would be equally spaced apart from each other providing a fixed angualr relationship with each other.

The emitted signal being transmitted by means of feed wire 20 to amplifier 24 and circuitted back to sensor 18 through wire 22 influences the flow of electrical current provided by energizer 40 interconnecting amplifier 24 through ignition switch 38 feed wire 36 resistor R2 and wire 30. The influenced circuit being connected to the primary of ignition coil 48 causes a sudden reaction in the secondary thereof, thereby the ignition coil 48 produces high voltage sparks successively applied through wire to contact lever 45 disposed on secondary rotor distributor 49 is mounted on driving shaft 12.

Contact lever 45 connects a first peripheral terminal which is electrically connected to spark plug 39 by means of high voltage wire 37 providing firings into cylinder 56; at a respective time in the engine cycle. Contact lever 45 subsequently connects the second peripheral terminal which is connected by wire 35 to ignition plug 41 by means of high voltage wire 35, the connecting terminals being arranged at an equal angle from each other providing a fixed relationship. Ignition plug 41 is positioned in cylinder 58 for applying firings thereinto.

While certain novel features of this invention have been shown and described and are pointed out in the annexed claims, it will be understood that various omissions, substitutions, and changes in the forms and details of the device illustrated and in its operation can be made by those skilled in the art without departing from the spirit of the invention.

We claim:

1. An ignition system for a multi-cylinder internal combustion engine comprising in combination;

a timing housing means including an orifice on the upper surface admitting light beams emanating from a radiant energy source, a driving shaft in said timing housing, a cone shaped rotor member means mounted on said driving shaft and rotated within said housing; means including said shaft for displacing said rotor member means in synchronism with the engine rotations, said rotor member means including an open end chamber being rotated adjacent said orifice in said housing admitting beams from said energy source thereinto; and a plurality of apertures therein as there are cylinders in the engine and being spaced apart at equal angles such that there exists a fixed relationship with each other, said apertures extending into said chamber, wherein said apertures on said rotor member means operate a photo electric cell means allowing focusing thereon causing an electrical emission, and wherein spaces separating said apertures prevent focusing on said photo cell thereby said photo cell does not electrically emit resulting in a phased interval influence signal and wherein the number of aperatures on said rotor member means and the rotating speed of said driving shaft determine the frequency of said influence signal.

2. The combination of claim 1 and wherein a first means transmits said influence signal from said photo cell means to an amplifier means and a second means connects said amplifier to said photo cell, and third connecting a power source to said amplifier including an input connection, and fourth means connecting said amplifier means to an ignition coil including an input connection, and fifth means connecting an output connection on said ignition coil to a resillient contact means.

3. The combination of claim 2 and wherein said resillient contact means is in resillient contact with a secondary high voltage circuit rotary switch means, means for displacing said rotary switch means in synchronism with the engine rotations, a first ignition plug connected to said switch means, wherein upon rotation of said switch means a secondary electrical path is provided from output of said ignition coil through said contact means and said switch means to said first ignition plug said first ignition plug being in communication with a first engine cylinder providing high voltage firing into said first cylinder at a respective time in the engine cycle.

4. The combination of claim 3 and wherein said resillient contact means in resillient contact with said rotary switch means subsequently connects a second ignition plug disposed and being angularly spaced apart on said rotary switch means and at said equal angles and being at said relationship as said apertures on said rotor member means while being in communication with second engine cylinder providing high voltage firing into said second cylinder at a respective time in said cycle.

5. The combination of claim 1 and wherein said photo cell being angularly positioned in said timing housing parallel to the periphery of said cone-shaped rotor member means.

6. The combination of claim 5 and wherein said cone-shaped rotor member means on said driving shaft defines a Y member operating said photo cell.

7. The combination of claim 1 and wherein a first means transmits said influence signal from said photo cell means to an amplifier means, and a second means connecting said amplifier to said photo cell, and third means connecting a power source to said amplifier including an input connection, and fourth means connecting said amplifier means to an ignition coil including an input connection, and fifth means connecting an output connection on said ignition coil to a resillient contact means in resillient contact with means for switching including a contact lever having a contact tip and being disposed on a secondary circuit high voltage distribution rotor mounted on said criving shaft for connecting, respectively, each of a plurality of peripheral contact means equal in number and equally spaced as said apertures on said rotor member means and corresponding to the number of cylinders in the engine so to form a distributor assembly, each said contact means being electrically connected to an ignition plug fitted into an associated cylinder.

* * * * *